US009296595B2

(12) United States Patent
Downing

(10) Patent No.: US 9,296,595 B2
(45) Date of Patent: Mar. 29, 2016

(54) CAB FOR HEAVY EQUIPMENT HAVING MULTIPLE POINTS OF INGRESS AND EGRESS

(71) Applicant: Altec Industries, Inc., Birmingham, AL (US)

(72) Inventor: James A. Downing, Salem, VA (US)

(73) Assignee: Altec Industries, Inc., Birmingham, AL (US)

( * ) Notice: Subject to any disclaimer, the term of this patent is extended or adjusted under 35 U.S.C. 154(b) by 36 days.

(21) Appl. No.: 14/188,120

(22) Filed: Feb. 24, 2014

(65) Prior Publication Data

US 2015/0239714 A1 Aug. 27, 2015

(51) Int. Cl.
*B66C 13/54* (2006.01)

(52) U.S. Cl.
CPC ..... *B66C 13/54* (2013.01)

(58) Field of Classification Search
CPC ..... B66C 13/54; B60J 5/0487; E02F 9/163
USPC ..... 296/190.04, 190.01, 190.05, 190.08, 296/190.11
See application file for complete search history.

(56) References Cited

U.S. PATENT DOCUMENTS

| | | | | |
|---|---|---|---|---|
| 5,413,188 | A * | 5/1995 | Ui | 180/89.12 |
| 6,022,182 | A * | 2/2000 | Everett | 414/544 |
| 6,095,263 | A * | 8/2000 | Saunders et al. | 175/219 |
| 6,446,738 | B1 * | 9/2002 | Boyd | 175/219 |
| 7,243,982 | B2 * | 7/2007 | Kelley et al. | 296/190.08 |
| 7,347,488 | B2 * | 3/2008 | Hayes et al. | 296/190.08 |
| 2002/0121397 | A1 * | 9/2002 | Saarinen | 180/89.12 |
| 2004/0163865 | A1 * | 8/2004 | Shimokakiuchi et al. | 180/89.12 |
| 2007/0145759 | A1 * | 6/2007 | Crawford et al. | 296/1.01 |
| 2012/0224941 | A1 * | 9/2012 | Peterson et al. | 414/507 |
| 2013/0140092 | A1 * | 6/2013 | Warr | 175/219 |

* cited by examiner

*Primary Examiner* — Jason S Morrow
*Assistant Examiner* — E Turner Hicks
(74) *Attorney, Agent, or Firm* — Erise IP, P.A.

(57) ABSTRACT

An operator cab for an operator of heavy equipment, the cab including a first opening and a second opening through which an operator can enter or exit the cab. The cab is mounted on the heavy equipment next to an implement for performing work. The first opening and the second opening of the cab are not generally parallel to each other. The cab is operable to rotate to a first position with respect to the deck of the heavy equipment, such that the operator can exit through the first opening and onto the deck. The cab is also operable to rotate to a second position with respect to the deck of the heavy equipment, such that the operator can exit through the second opening and onto the deck. The multiple openings in the cab assist the operator in safe ingress and egress to and from the deck and cab.

20 Claims, 7 Drawing Sheets

CAB FOR HEAVY EQUIPMENT HAVING MULTIPLE POINTS OF INGRESS AND EGRESS

BACKGROUND

1. Field

Embodiments of the invention relate to an operator cab for heavy equipment, such as a crane or aerial device. Particularly, embodiments of the invention relate to an operator cab with two openings on nonparallel sides for access to the operator cab. Further embodiments relate to an operator cab with a single opening that radially spans up to and including an approximate 170-degree angle about a vertical axis.

2. Related Art

Operator cabs for heavy equipment, such as aerial devices are sometimes mounted on a vehicle chassis behind a chassis cab. The heavy equipment frequently includes an implement, such as a crane or digger derrick, that is also mounted to the vehicle chassis. In some instances, both the implement and the operator cab may be mounted to a turntable, which is mounted on a deck, and the deck is mounted on the vehicle chassis.

The conventional access to the operator cab is through an opening provided by a side-facing door on the opposite side of the implement. Because of the narrow width of the chassis to allow for road travel, the heavy equipment does not provide a deck with sufficient width to allow the operator to exit the cab onto the deck at all points of rotation of the cab relative to the deck. Without a sufficient width of deck for the operator to stand upon, the operator must climb up the side of the heavy equipment while entering or exiting the operator cab.

The problem of a safe point of ingress and egress is not solved by only a front-facing door. The front-facing door provides direct access between the operator cab and the deck while the implement is in a stowed position. In the stowed position, the implement is in-line with a major axis of the chassis, and as such, the implement is positioned parallel with a length of a deck of the heavy equipment. During operation, however, the operator cab and the implement may be facing off the left or right sides of the heavy equipment. When the operator cab is facing the sides, the front-facing door now has similar problems as a side door in that to exit the cab, the operator must climb on the side of the heavy equipment or jump from the cab and to the ground below.

SUMMARY

In accordance with a first embodiment of the invention, an operator cab for heavy equipment having an associated implement to perform work and a deck for safe ingress and egress to the cab comprises a first opening and a second opening. The first and second openings are sized to provide points of ingress and egress for an operator of the cab. The first and second openings of the cab are not generally parallel to each other and thus, are not positioned on parallel sides of the cab. The cab is operable to rotate to a first position with respect to the deck such that the operator can exit directly onto the deck from the first opening. The cab is operable to rotate to a second position different from the first position such that the operator can exit directly onto the deck from the second opening. The second position is less than 180 degrees of rotation form the first position.

In accordance with a second embodiment of the invention, an operator cab for heavy equipment having an associated implement to perform work and a deck for safe ingress and egress to the cab comprises a first opening and a second opening. The first and second openings are sized to provide points of ingress and egress for an operator of the cab. The first and second openings of the cab are not generally parallel to each other and thus, are not positioned on parallel sides of the cab. The cab is operable to rotate to a first position with respect to the deck such that the operator can exit directly onto the deck from the first opening. The cab is operable to rotate to a second position different from the first position such that the operator can exit directly onto the deck from the second opening. The first opening of the cab maintains a fixed relative position with respect to the implement, such that a midline of the implement and a midline of the cab either form a fixed angle or are parallel.

In accordance with a third embodiment of the invention, an operator cab for heavy equipment having an associated implement to perform work and a deck for safe ingress and egress to the cab comprises a single opening. The single opening is sized to provide multiple points of ingress and egress for an operator of the cab. The single opening has an opening radius of 100-170 degrees. In some embodiments, the opening radius of the single opening may be obstructed by one or more support being less than or equal to 20 degrees.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the current invention will be apparent from the following detailed description of the embodiments and the accompanying drawing figures.

BRIEF DESCRIPTION OF THE DRAWING FIGURES

Embodiments of the current invention are described in detail below with reference to the attached drawing figures, wherein.

Figure 1:
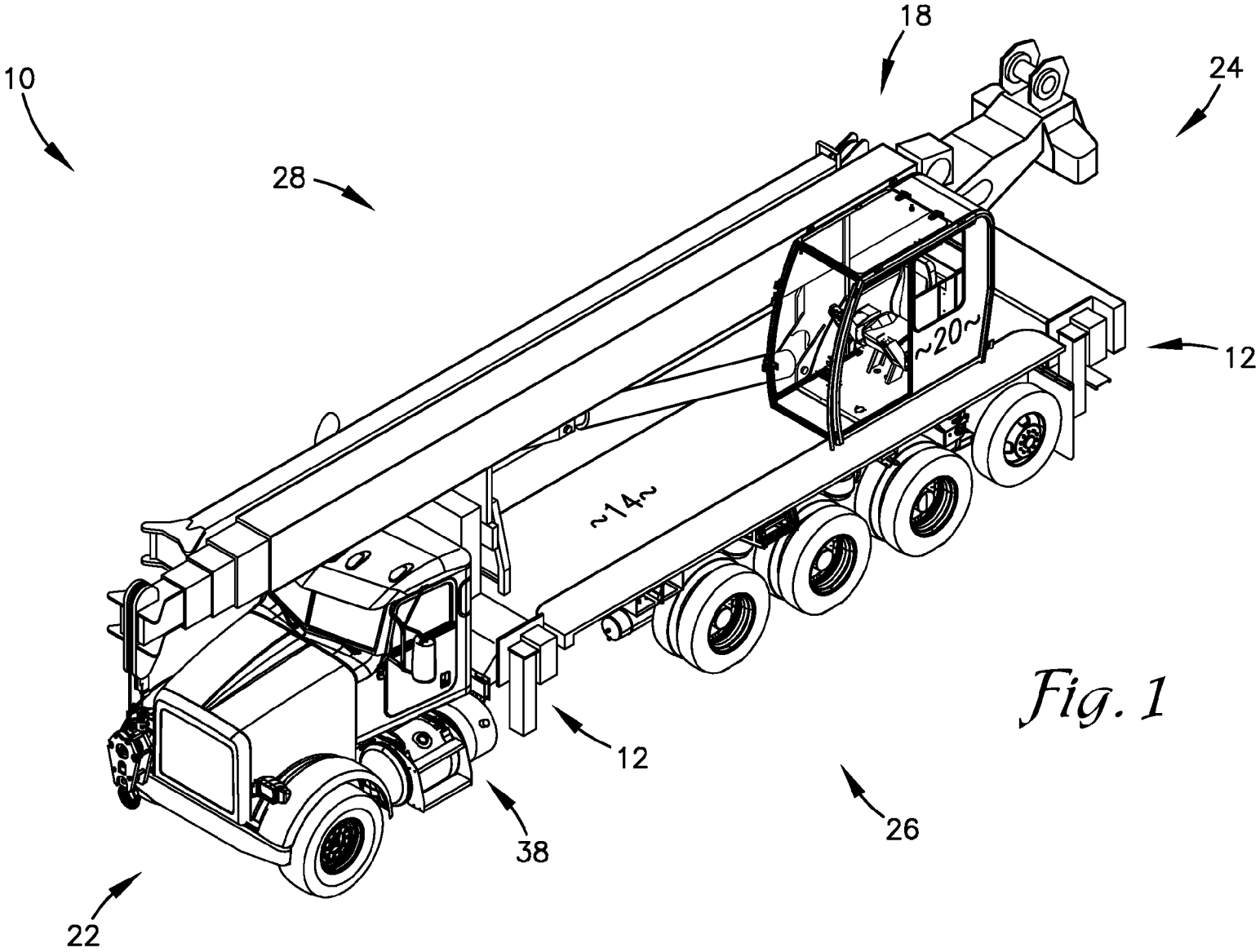
FIG. 1 is a perspective view of an item of heavy equipment configured for travel down a roadway with an operator cab of embodiments of the invention.

The drawing figures do not limit the current invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the current invention. The following detailed description is, therefore, not to be taken in a limiting sense. The scope of the current invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the current technology can include a variety of combinations and/or integrations of the embodiments described herein.

Turning to the figures, and particularly FIG. 1, an embodiment of the present invention relates to heavy equipment 10 for lifting loads, excavating dirt, or other earth-working or heavy-lifting activities. The heavy equipment 10 generally comprises a rigid chassis 12; a deck 14 for an operator to stand upon; a rotatable turntable 16 (depicted in FIG. 4); an implement 18 to do work; and a cab 20 to house the operator of the heavy equipment. Embodiments of the invention provide for the cab 20 to have multiple points of ingress and egress provided by multiple openings to allow the operator to safely enter and exit the cab from multiple cab positions.

Figure 2:
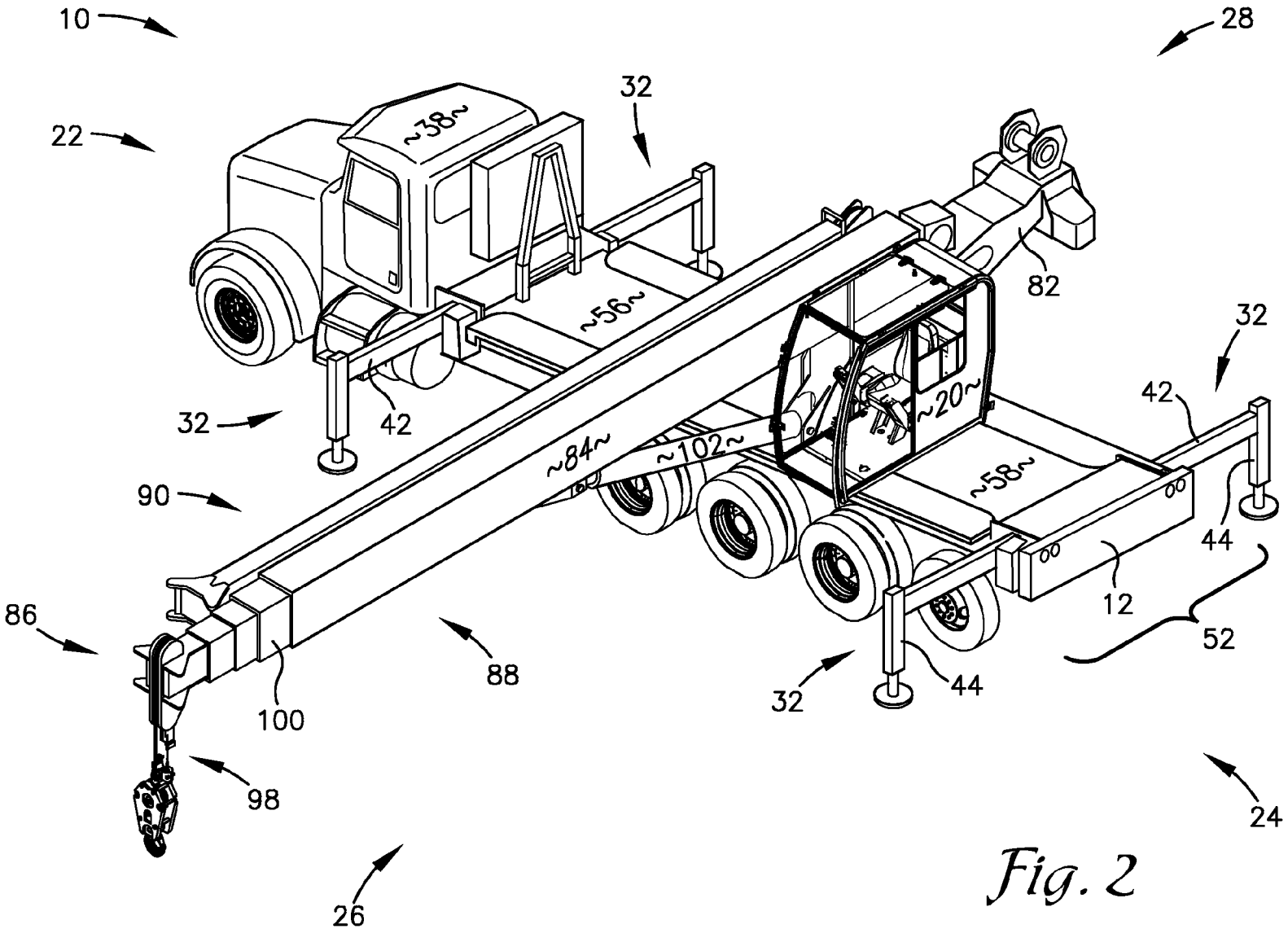
FIG. 2 is a perspective view of an item of heavy equipment configured for performing work with an operator cab of embodiments of the invention.

As depicted in FIGS. 1 and 2, the heavy equipment 10 presents a front end 22 and a rear end 24. The front end 22 is positioned distal from the implement 18 and the rear end 24 is positioned proximate the implement. A left side 26 and a right side 28 of the heavy equipment 10 are identified when viewing the heavy equipment from the rear end 24, such that the left side is a street side or driver side, and the right side is a passenger side or curb side.

Figure 4:
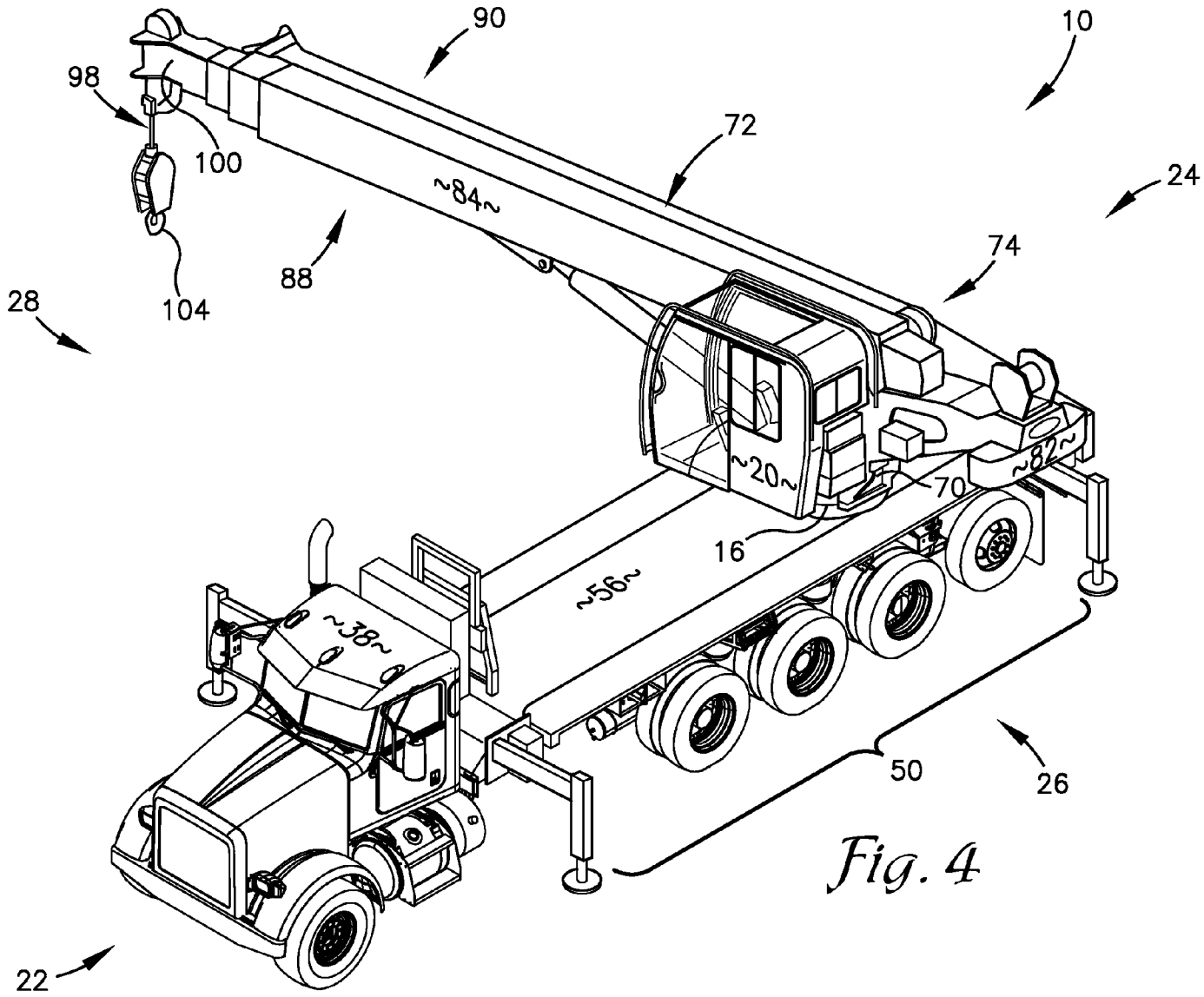
FIG. 4 is a second perspective view of an item of heavy equipment configured for performing work with an operator cab of embodiments of the invention.

Turning to FIGS. 1, 2, and 4, the chassis 12 comprises a frame for mounting of the components and a set of outriggers 32 for machine stabilization. The bottom of the frame provides a mounting point for wheels if the heavy equipment 10 is mobile. In embodiments of the invention, mounted on the bottom are railroad wheels for heavy equipment that is towed by a locomotive. In other embodiments of the invention, the bottom of the frame permanently attaches to a boat hull to facilitate the heavy equipment 10 floating on a body of water. In still other embodiments, the bottom of the frame provides a mounting point to mount crawler tracks.

The top of the frame provides mounting for the other major components of the heavy equipment 10. In particular, the deck 14 and the turntable 16 are mounted to the top of the frame. Additionally, in embodiments where the heavy equipment 10 is part of a truck chassis, the top of the frame 10 provides a place to mount a truck cab 38. In this embodiment, the truck cab 38 is mounted proximal to the front end 22 of the heavy equipment 10, and the turntable 16 is mounted proximal to the rear end 24.

The outriggers 32 are positioned along the chassis 12 to provide additional stability for the heavy equipment 10 when manipulating heavy loads. The outriggers 32 are permanently attached to the frame of the chassis 12. They are located on the left 26 and right sides 28 of the heavy equipment 10 and may extend a small distance from the chassis 12. Each outrigger 32 has an extendable member 42 that may be positioned horizontally away from the sides 26,28 of the heavy equipment 10 and a vertical support 44 that is operable to contact the ground when the outrigger is deployed. In embodiments of the invention, there may be only a single outrigger 32 on each side 26,28 of the heavy equipment 10. In other embodiments, there are multiple outriggers 32 on each side 26,28. In embodiments with aforementioned crawler tracks, there may not be any outriggers 32 on the frame of the chassis 12.

As shown in FIGS. 1, 2, and 4, the deck 14 of the heavy equipment 10 provides a safe place for the operator to climb up on the heavy equipment 10 and an area to enter and exit the cab 20. The deck 14 has an opening (not depicted) for the turntable 16. The deck 14 mounts to the top of the chassis 12 of the heavy equipment 10. The deck 14 is generally flat with a major horizontal dimension 50 and a minor horizontal dimension 52. The major horizontal dimension 50 extends from the front end 22 to the rear end 24 of the heavy equipment 10. The minor horizontal dimension 52 extends from the left side 26 to the right side 28 of the heavy equipment 10. The surface of the deck 14 may be textured or grooved to discourage the operator from slipping while walking around on the deck.

The opening of the deck 14 is large enough for the turntable 16 to protrude up from the chassis 12 and above the surface of the deck. The opening is centered along the minor horizontal dimension 52 leaving two small areas on the left 26 and right sides 28 of the heavy equipment 10. The opening is located between the front end 22 and the rear end 24 of the heavy equipment 10 proximal to the rear end leaving a first platform 56 and a second platform 58. The first platform 56 is located between the front end 22 of the heavy equipment 10 and the turntable 16. The second platform 58 is located between the turntable 16 of the heavy equipment 10 and the rear end 24.

Referring to FIG. 4, the turntable 16 of the heavy equipment 10 comprises a lower section (not depicted) mounted to the frame of the chassis 12; an upper section (not depicted) to provide a mounting area for the implement 18 and the cab 20; and a connection (not depicted) rotatably coupled to the lower section and the upper section. The turntable 16 is located inside the opening of the deck 14 and extends upwards starting with the lower section and ending with the upper section with the connection sandwiched in between. The lower section, upper section, and connection are each centrally hollow along the vertical axis. This hollow shape allows any electronic components and power lines (not depicted) to pass from the chassis 12 underneath the deck 14 up to the implement 18 and the cab 20. The connection of the turntable 16 allows the upper section to rotate 360 degrees about the vertical axis while the lower section remains permanently connected to the chassis 12. As will be discussed below, the rotation allows the implement 18 and the cab 20 to rotate to at least a first position with respect to the deck and a second position with respect to the deck. In embodiments of the invention, the connection allows rotation of the implement 18 and cab 20 in both clockwise and counterclockwise directions. Reference herein to a "first position" and "second position" is intended to refer to the positions of either or both of the implement 18 and the cab 20.

As shown in FIGS. 1, 2 and 4, the implement 18 comprises a base 70 to mount on the turntable 16 and a tool 72 extending from the base. The base 70 is coupled to the upper section of the turntable 16 to allow the base and thus the tool 72 to rotate into the first position and the second position when the turntable rotates. The base 70 has a pivotable connection 74 allowing the tool 72 to tilt downwards towards the deck 14 and upwards away from the deck 14 of the heavy equipment 10. When the base 70 tilts the tool 72 as far away from the deck 14 as possible, the tool is at a maximum vertical angle with respect to deck of the heavy equipment 10. When the base 70 tilts the tool 72 to be generally parallel with the deck 14, the tool is at a stowed vertical angle with respect to the deck.

The base 70 of the implement 18 is configured to vertically elongate to a fixed height above the deck 14 of the heavy equipment 10. In embodiments with a truck cab 38, the fixed height of the base 70 provides sufficient vertical distance for the turntable 16 to rotate the tool 72 above the truck cab while the tool is tilted to a stowed vertical angle. In embodiments of the invention, the base 70 is further comprised of a ballast 82 extending opposite of the tool 72. The ballast 82 extends outward horizontally, such that when the tool 72 is pointed by the turntable 16 towards the front end 22 of the heavy equipment 10, the ballast points towards the rear end 24.

The tool 72 of the implement 18 is comprised of an arm 84 elongated away from the base 70, and a tip 86 of the arm distally located from the base. When the arm 84 is located at the stowed vertical angle by the base 70 and in the first position 66 by the turntable 16, the arm 84 is generally parallel to the major horizontal dimension 50 and over the first platform 56 of the deck 14. In an exemplary first position of the implement 18 and cab 20, the arm 84 and thus the tip 86 of the tool 72 are facing the front end 22 of the heavy equipment 10. Also when in this exemplary first position 66, the tip 86 of the implement 18 is generally proximal to the front end 22 of the heavy equipment 10. The arm 84 has a left side 88 and a right side 90. When in the exemplary first position, the left side 88 and the right side 90 of the arm 84 correspond to the left side 26 and the right side 28 of the heavy equipment 10.

The reference above to the "exemplary" first position is intended to highlight that the first position is an arbitrary point or position within the 360 degree rotation of the turntable. Thus, one exemplary first position is where the implement 18 and cab 20 face the front end 22 of the heavy equipment 10. However, the first position 66 could be any other position within the 360-degree rotation of the cab. The second position is then defined relative to the first position, such that the second position is less than 180 degrees from the first position in either a clockwise or counterclockwise rotation.

In an exemplary second position of the implement 18 and cab 20, the length of the arm 84 faces directly outwards to the left 26 or right sides 28 of the heavy equipment 10. In this exemplary second position, the cab 20 is rotated approximately 90 degrees from the exemplary first position where the cab 20 is facing the front end 22 of the heavy equipment 10. In this exemplary second position, the arm 84 extends over the left 26 or right sides 28 of the heavy equipment 10 and is parallel to the minor horizontal dimension 52 of the deck 14. The exemplary first position provides the position when a maximum area of deck surface is available for safe ingress/egress out of a first opening 118 (described in more detail below). In contrast, the exemplary second position provides the position when a maximum area of deck surface is available for safe ingress/egress out of a second opening 120 (described in more detail below). Again, the first and second positions, are arbitrary, except that the second position is less than 180 degrees from the first position.

In embodiments of the invention, the implement 18 is a crane as shown in FIGS. 2 and 4. The arm 84 of the crane comprises an extendable multiple-section boom 100; a cable 98 to lift loads; a channel (not depicted) to guide the cable, and a set of hydraulics 102 to tilt and extend the boom. The tip 86 of the implement 18 is a hook 104 attached to the end of the cable 98 operable to raise and lower loads. As can be appreciated, the implement may be other devices, such as a multi-piece arm and a bucket tip to scoop material, or a telescoping arm and a tip that is a generally enclosed platform to house a person.

Figure 3:
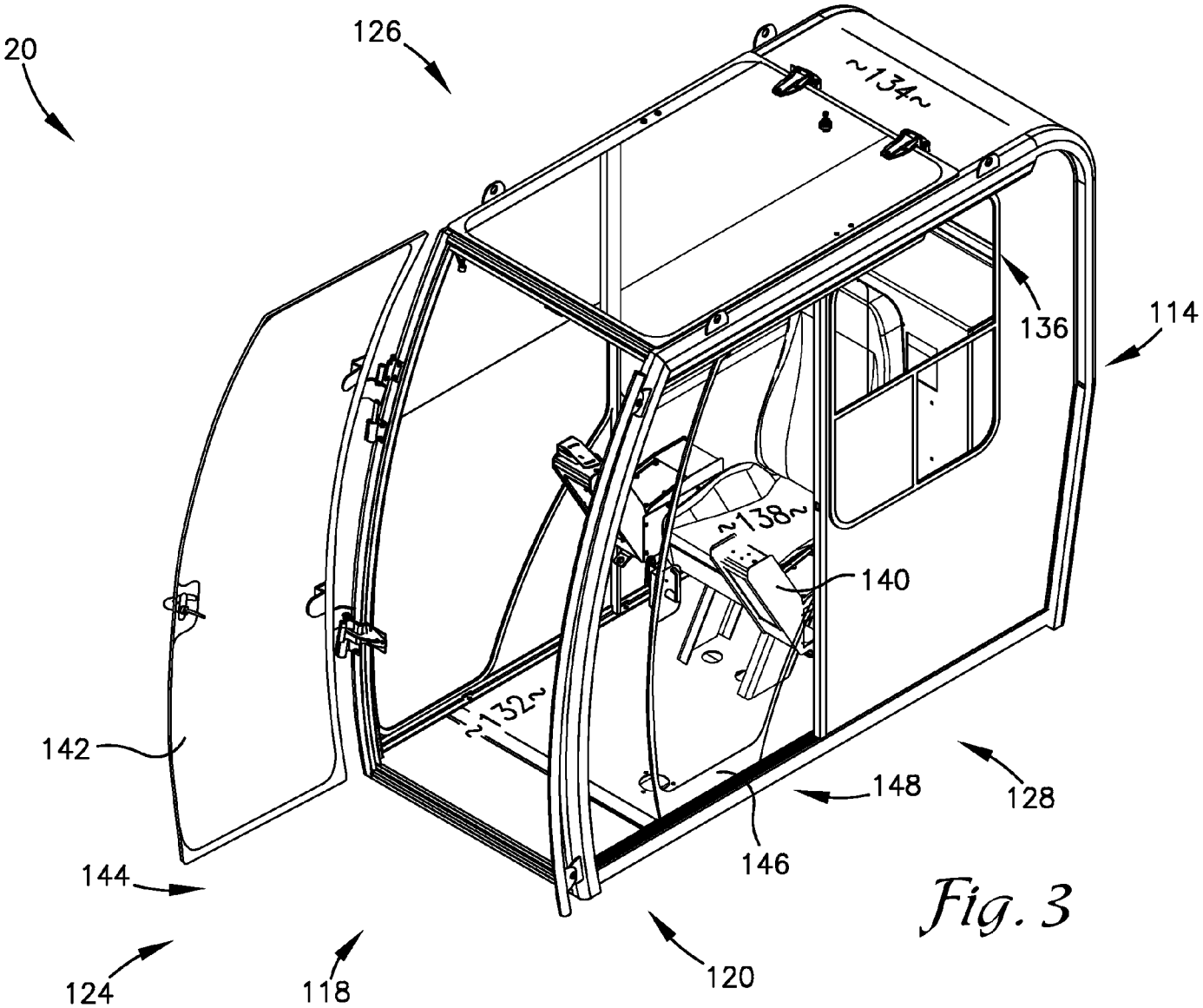
FIG. 3 is a perspective view of an operator cab of embodiments of the invention.

Turning now to FIG. 3, the cab 20 of the heavy equipment 10 is broadly comprised of a frame 114, and one or more openings 118,120,122 sized and configured to allow the operator to access the interior of the cab through one of the openings. The cab 20 is mounted on the turntable 16 next to the implement 18 on either the left 88 or right sides 90 of the arm 84 of the tool 72. The cab 20 includes at least a first access side 124, a working side 126, and a second access side 128 generally opposite the working side. The first access side 124 is generally aligned with the first opening 118; the second access side 128 is generally aligned with the second opening 120; and the working side 126 is opposite (i.e., approximately 180 degrees) from the second access side 128. Thus, when the turntable 16 is in the exemplary first position with respect to the deck 14, such that the cab 20 is facing the front end 22 of the heavy equipment 10, the first access side 124 also faces the front end 22 of the heavy equipment 10, and the second access side 128 faces and is generally aligned with the left side 26 of the heavy equipment 10.

In embodiments of the invention, when the cab 20 is mounted to the left side 88 of the arm 72 of the implement 18, the working side 126 of the cab 20 faces the right side 28 of the heavy equipment 10 and the second access side 128 of the cab is on the left side 26 of the heavy equipment. It should be appreciated that in embodiments where the cab 20 is mounted to the right side 90 of the arm 72, then the working side 126 of the cab 20 faces the left side of the heavy equipment 10 and the second access side 128 of the cab is on the right side 28 of the heavy equipment 10.

The frame 114 of the cab includes a floor 132, a ceiling 134, one or more windows 136, and at least one generally vertical support extending between the floor 132 and the ceiling 134. The windows 136 allow the operator to see out of the cab, including seeing any obstacles, when operating the cab and associated implement. The frame 114 of the cab 20 is generally rectangular shaped with the first access side 124 being shorter in width than a width of the working side 126 and second access side 128. In other embodiments, the frame 114 may be other general shapes, such as circular, oval, square, or an irregular shape. For example, in embodiments the frame 114 may be generally arcuate with the first access side 124 continuously curving into the working side 126 and the second access side 128. In other embodiments, the frame 114 may be generally hexagonal, octagonal, or any other multi-faceted shape. In any of the embodiments, each of the first access side 124, working side 126, and second access side 128 may be made of multiple sub-frames.

The floor 132 of the cab 20 is fixed to the turntable 16 to allow the cab to rotate with the implement 18. In other embodiments, the floor 132 of the cab 20 may be fixed to a turntable distinct from the turntable that rotates the implement 18. The distance from the deck 14 of the heavy equipment 10 to the floor 132 of the cab 20 is nominal to allow an operator to easily step from the deck 14 to the cab 20. In embodiments of the invention, the floor 132 of the cab 20 is pivotably mounted to the turntable 16 for tilting the first access side 124 of the cab 20 upwards away from the deck 14. This tilting allows for the operator to more easily see the implement 18 when it is tilted above the stowed vertical angle. The tilting does not alter the horizontal relationship of the cab 20 and the implement 18, as described below.

Inside the cab 20 comprises a seat 138 for the operator and controls 140 to instruct the implement 18. The seat 138 is mounted opposite the first access side 124 of the cab 20 and faces the first access side 124. The seat 138 is attached to the cab 20 sufficiently above the floor 132 to allow the operator to look through the windows 136 and to reach the controls 140 while seated. In other embodiments, there may not be a seat but only an area for the operator to stand. The controls 140 are located to the left and right of the seat 138, but in other embodiments, the controls 140 may be above or in front of the seat 138 or in some other combination of places in the interior of the cab 20.

The cab 20 has a first opening 118 and a second opening 120. The first opening 118 is on the first access side 124 of the cab 20 and allows ingress and egress to the interior of the cab from the deck 14 of the heavy equipment 10. Mounted in the first opening 118 of the cab 20 is a first door 142 operable to be selectively moved to open and closed positions (an open position 144 is shown in the drawings). Similarly, the second opening 120 is on the second access side 128 of the cab 20 and allows ingress and egress to the interior of the cab from the deck 14. Mounted in the second opening 120 of the cab 20 is a second door 146, which is also operable to be selectively moved to open and closed positions (an open position 148 is shown in the drawings). The second opening 120 of the cab 20 is not generally parallel to the first opening 118 and thus, not generally parallel to the implement 18. Reference to the first opening 118 herein is intended to encompass the first door 142 being in the open position 144 to allow ingress/egress from the cab 20, and reference to the second opening 120 is intended to encompass the second door 146 being in the open position 148 to allow ingress/egress from the cab 20. The first door 142 is mounted to the first access side 124 to allow the first door to open away from the second access side 128 and towards the working side 126 of the cab 20. Similarly, the second door 146 is mounted to the second access side 128 to allow the second door to open away from the first access side 124 of the cab 20. Various door configurations may be utilized for the first and second doors 142,146, including doors that fold, collapse, or slide open.

The turntable 16 is operable to place the cab 20 and thus the second opening 120 in various positions with respect to the deck 14. Various exemplary positions of the first and second positions are now described. When in the second position where the first opening 118 faces the left 26 or right sides 28, the second opening 120 faces the front end 22 or rear end 24 of the heavy equipment 10. In this embodiment of the second position, the second opening 120 is generally parallel to and above the first platform 56 or the second platform 58 of the deck 14. When in the second position where the first opening 118 faces less than a 180-degree angle towards the rear end 24 of the heavy equipment 10, the second opening 120 generally faces the right side 28 and not over the first 56 or second platforms 58 of the deck 14.

When in the second position where the first opening 118 generally faces the front end 22 or the rear end 24 of the heavy equipment 10, the second opening 120 is minimally over the first 56 or second platforms 58 of the deck 14. When in the second position where the first opening 118 generally faces the left 26 or right sides 28 of the heavy equipment 10, the second opening 120 is substantially over the first 56 or second platforms 58. Thus, at any time either the first opening 118 or the second opening 120 of the cab 20 is over either the first platform 56 or the second platform 58 of the deck 14 of the heavy equipment 10.

In embodiments of the invention and when viewing the heavy equipment 10 from above (i.e., a plan view), the cab 20 maintains a fixed relative position to the implement 18 throughout rotation of the implement. Thus, when the implement 18 rotates, the cab 20 also rotates with the implement. Specifically, the arm 84 and the tip 86 would be facing the same direction as the first opening 118 and the first access side 124 regardless of which way the implement 18 and the cab 20 are rotated by the turntable 16.

To further explain, an exemplary first position is where the tip 56 of the implement 18 and the first access side 124 of the cab 20 are both facing the front end 22 of the heavy equipment 10, and thus, the cab and implement are parallel to each other. If the implement 18 is rotated clockwise by the turntable 16 at a speed of a single revolution per minute and stops after 7.5 seconds of rotation, the implement will be facing 45 degrees from the exemplary first position. Because the cab 20 maintains a fixed relative position to the implement 18, the cab is also facing 45 degrees from the exemplary first position. Continuing the explanation, if the implement 18 were to resume rotation at 45 degrees from the exemplary first position for another 2.5 seconds at the same speed and direction, because the cab 20 maintains a fixed relative position with respect to the implement, both the implement and the cab would be facing 60 degrees from the exemplary first position.

Figures 5, 6, 7:
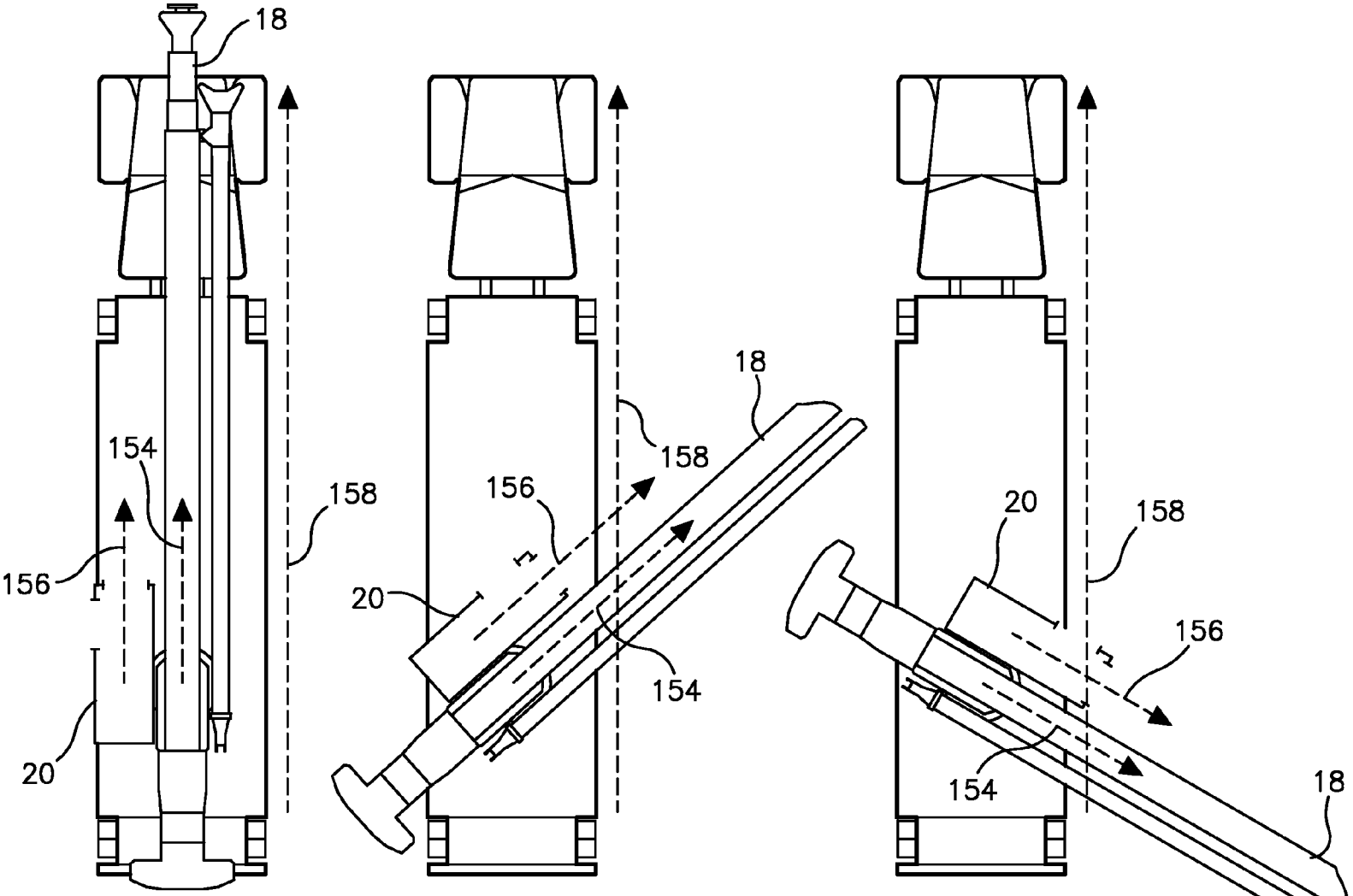
FIG. 5 is a first top-down view of an implement and an operator cab parallel to the heavy equipment of embodiments of the invention.
FIG. 6 is a second top-down view of an implement and an operator cab at a fixed angle to the heavy equipment of embodiments of the invention and rotated to a first position.
FIG. 7 is a top-down view of an implement and an operator cab at the fixed angle to the heavy equipment of embodiments of the invention and rotated to a second position.
Figure 10:
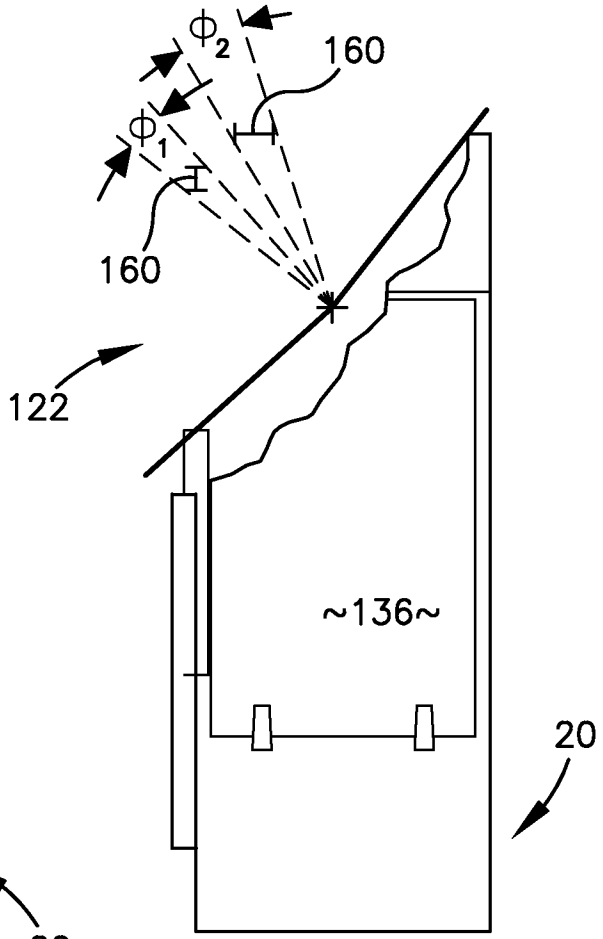
FIG. 10 is a top-down view of an operator cab of embodiments of the invention with a continuous single opening and highlighting an obstruction radius of a pair of support structures.
Figure 9:
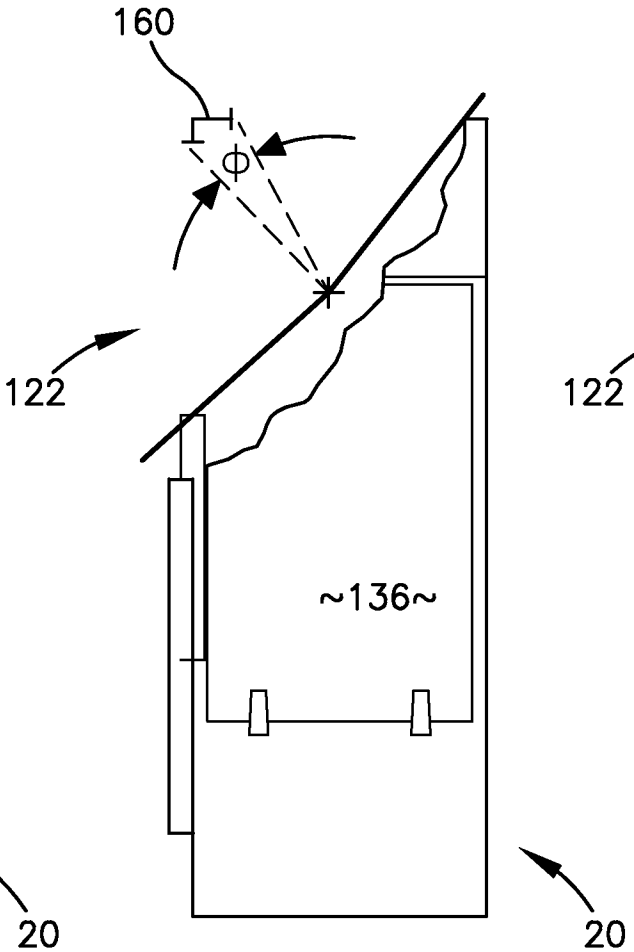
FIG. 9 is a top-down view of an operator cab of embodiments of the invention with a continuous single opening and highlighting an obstruction radius of a support structure.
Figure 8:
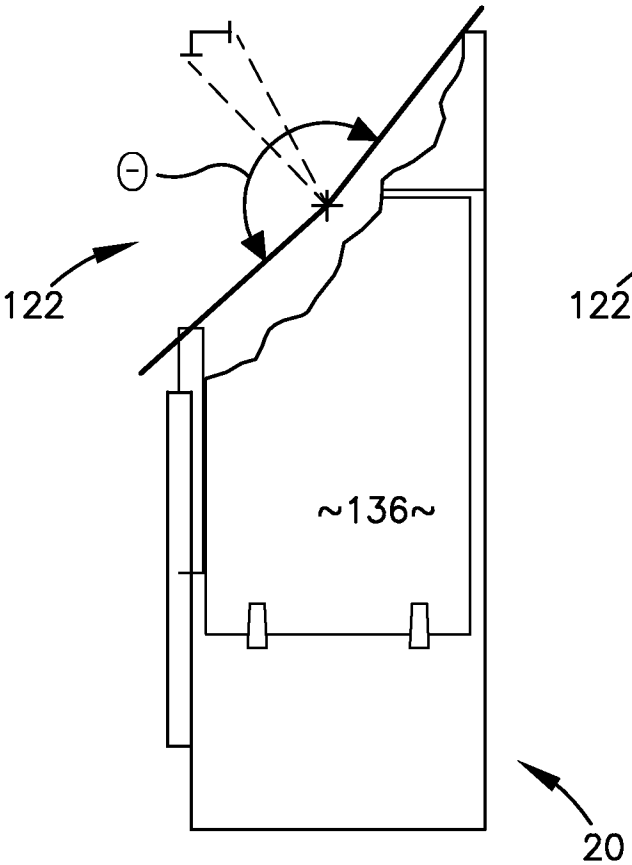
FIG. 8 is a top-down view of an operator cab of embodiments of the invention with a continuous single opening and highlighting an opening radius of the single opening.
Figure 11:
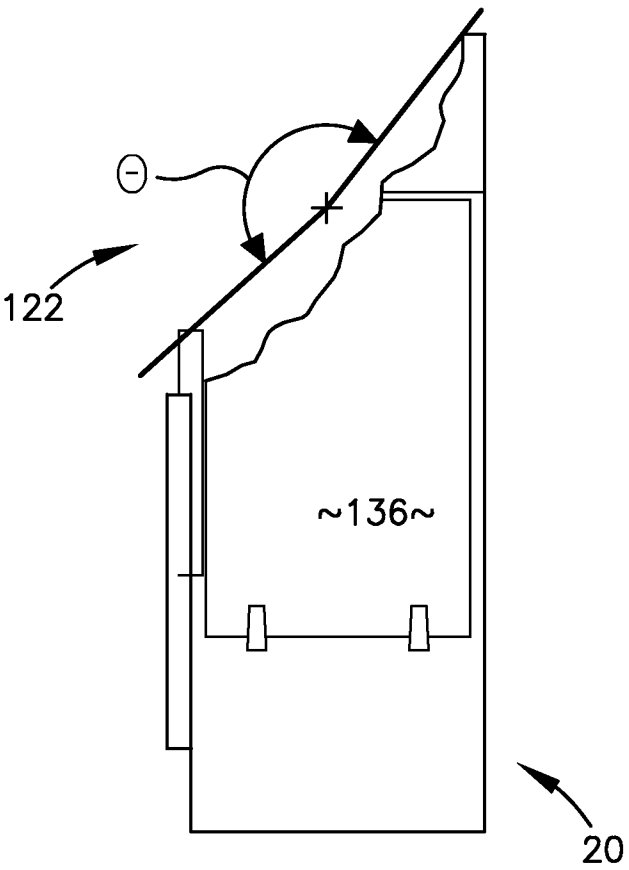
FIG. 11 is a top-down view of an operator cab of embodiments of the invention with a continuous single opening and highlighting an opening radius of the single opening.

Specifically in FIGS. 5-7 is illustrated the consistent alignment of the implement 18 and the cab 20 with a first midline 154 representing a midline of the implement and a second midline 156 representing a midline of the cab is illustrated. The first midline 154 begins at the base 70 of the implement 18 continuing along to the tip 86 of the tool 72. The second midline 156 begins at the cab 20 extending outward perpendicular to the first access side 124 of the cab. A reference line 158 begins at the rear end 24 of the heavy equipment 10 towards the truck cab 38 and on to the front end 22. In FIG. 5 the first midline 154 and the second midline 156 are both parallel to the reference line 158. In both FIGS. 6 and 7 the first midline 154 and the second midline 156 both have the same angle with respect to the reference line 158. It is appreciated that although FIGS. 5-7 illustrate just three positions, the implement 18 and the cab 20 could rotate together through 360 degrees of rotation or as many degrees of rotation provided by the turntable. Thus, the cab 20 maintains a fixed relative position with respect to the implement 18 throughout rotation of the implement.

As shown in FIGS. 8-11, in embodiments of the invention, the first and second openings are substantially continuous. The first and second openings provide a point of ingress and egress of approximately 100-170 degrees about a vertical axis extending through a middle of the cab 20, such that the first and second openings are essentially a single opening having an opening radius of 100-170 degrees. In embodiments of the invention, the single opening is unobstructed, such that the operator has the 100-170 degree opening radius in which the operator can enter or exit the cab. In other embodiments, the single opening has one or more obstructions comprising one or more support structures extending vertically between a top and a bottom of the cab. In this embodiment, the opening radius of the single opening may comprise an obstruction of less than or equal to 20 degrees, such that the opening radius is 100-170 degrees, except for the obstruction radius of less than or equal to 20 degrees. In embodiments, the single opening 122 starts on the first access side 124 of the cab 20 and continues around to the second access side 128 of the cab. In embodiments, the single opening 122 may be as small as a 100-degree angle about the vertical axis.

Mounted in the single opening 122 at the first access side 124 of the cab 20 is a first door 142 operable to allow access to the interior of the cab generally from the first access side. Mounted in the single opening 122 at the second access side 128 of the cab 20 is a second door 146 operable to allow access to the interior of the cab generally from the second access side. The first door 142 and the second door 146 are operable to vary the size of the single opening 122. The first door 142 and the second door 146 operate independently of each other. Many door configurations may be utilized, and the first door 142 and the second door 146 may operate by folding, collapsing, sliding, or some other combination. Further, the first door 142 and the second door 146 may be two different types of doors; for example, the first door may operate by folding, whereas the second door may operate by sliding.

As noted above, in some embodiments of the invention, the single opening 122 further comprises a support 160. The support 160 extends vertically from the floor 132 of the cab 20 upwards to the ceiling 134. The support 160 is positioned in the single opening 122 and obstructs up to 20 degrees of the single opening. The support 160 forms part of the frame 114 of the cab 20 and helps support the ceiling 134. The support structure 160 could be single or multiple pieces spaced throughout the single opening 122.

Use of the cab of embodiments of the invention will now be described. During operation of the heavy equipment 10, the operator may need to exit the cab 20. When the first access side 124 of the cab 20 is facing the left 26 or right sides 28 of the heavy equipment 10, the first opening 118 is not over the first 56 or second platforms 58 of the deck 14. In these situations if the operator needs to exit the cab 20, the operator can open the second door 146 to access the second opening 120 to exit onto the first 56 or second platforms 58 via the second access side 128 of the cab.

Sometimes the position of the turntable 16 with respect to the deck 14 faces the first access side 124 of the cab 20 between the front end 22 of the heavy equipment 10 and the left 26 and right sides 28. In this case the operator may choose whether to exit through the first 142 or second door 146 (or both) depending on the angle of the cab 20 with respect to the first platform 56 of the deck 14. Also, in some situations the turntable 16 faces the first access side 124 of the cab 20 between the rear end 24 of the heavy equipment 10 and the left 26 and rights sides 28. This presents the operator with a different choice: to exit the cab 20 through the first 142 or second door 146 (or both) depending on the angle of the cab with respect to the second platform 58 of the deck 14.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A cab associated with heavy equipment and configured to receive an operator therein during operation of the heavy equipment, the cab configured to be rotatably connected to a chassis of the heavy equipment having a deck providing safe entrance to and exit from the cab, the cab configured to be positioned proximate to an implement of the heavy equipment, the cab comprising:

a first opening through which the operator can enter and exit the cab; and a second opening through which the operator can enter and exit the cab, wherein the first opening and the second opening are not generally parallel to each other, said cab operable to rotate to a stowed position with respect to the deck, wherein while the cab is in the stowed position the first opening is configured to allow the operator to exit directly onto a top working surface of the deck from the first opening, said cab operable to rotate to an operating position with respect to the deck, wherein said operating position is different from said stowed position, wherein while the cab is in the operating position, the second opening configured to allow the operator to exit directly onto the top working surface of the deck from the second opening, wherein the cab is configured to provide a safe egress route for the operator directly onto the top working surface of the deck in either the stowed position or the operating position.

2. The cab of claim 1, wherein the first opening and the second opening are spaced approximately 70-120 degrees from each other.

3. The cab of claim 1, wherein the operator is prevented from egressing directly onto the deck from the first opening while the cab is in the operating position and from the second opening while the cab is in the stowed position.

4. The cab of claim 1, wherein the heavy equipment presents a front end, a rear end, and left and right sides, wherein the stowed position of the cab is defined by the first opening facing one of said front or rear ends of the heavy equipment.

5. The cab of claim 4, wherein the operating position of the cab is defined by the first opening facing one of said left or right sides of the heavy equipment.

6. The cab of claim 1, further comprising:

a first door mounted in said first opening, wherein the first door is operable to swing open away from said second opening; and a second door mounted in said second opening, wherein the second door is operable to slide open away from said first opening.

7. A cab associated with heavy equipment and configured to receive an operator therein during operation of the heavy equipment, the cab configured to be rotatably connected to a chassis of the heaving equipment having a deck providing safe entrance to and exit from the cab, the cab configured to positioned proximate to an implement of the heavy equipment on a working side of the cab, the cab comprising:

a first opening through which the operator can enter and exit the cab; and a second opening opposite said working side through which the operator can enter and exit the cab, wherein the first opening and the second opening are not generally parallel to each other, said cab operable to rotate to a stowed position with respect to the deck, such that the operator can exit directly onto a to working surface of the deck from the first opening, said cab operable to rotate to an operating position with respect to the deck, wherein said operating position is different from said stowed position, such that the operator can exit directly onto the to working surface of the deck from the second opening, wherein the cab is configured to be mounted on a turntable for rotating the cab and the implement about a common vertical axis and relative to the deck, wherein the cab maintains a fixed relative position with respect to the implement throughout rotation of the implement, such that a midline of the implement and a midline of the cab either form a fixed angle or are parallel.

8. The cab of claim 7, wherein the first opening and the second opening are spaced approximately 70-120 degrees from each other.

9. The cab of claim 7, wherein the first opening is oriented forward such that it is approximately normal to said midline of the cab, and the second opening is oriented to approximately orthogonal to the first opening and opposite said working side.

10. The cab of claim 7, wherein the heavy equipment presents a front end, a rear end, and left and right sides, wherein the stowed position of the cab is defined by the first opening facing one of said front or rear ends of the heavy equipment.

11. The cab of claim 10, wherein the operating position of the cab is defined by the first opening facing one of said left or right sides of the heavy equipment.

12. The cab of claim 7, further comprising:

a first door mounted in said first opening, wherein the first door is operable to swing open away from said second opening; and a second door mounted in said second opening, wherein the second door is operable to slide open away from said first opening.

13. A cab associated with heavy equipment and configured to receive an operator therein during operation of the heavy equipment, the cab configured to be rotatably connected to a chassis of the heavy equipment having a deck providing safe entrance to and exit from the cab, the cab configured to be positioned proximate to an implement of the heavy equipment on a working side of the cab, the cab comprising:

a first side;

a second side positioned generally adjacent to the first side and opposite said working side;

a first door located on the first side and operable to be positioned by the operator in either of a closed or an open position;

a second door located on the second side and operable to be positioned by the operator in either of a closed or an open position; and a single opening for entry to and exit from the cab, said opening created by at least one of the first and second doors being positioned in the respective open positions, wherein the opening has an opening radius that presents to the operator a safe ingress or egress onto a top working surface of the deck, wherein the second door is a sliding door so as to allow egress from the cab onto the top working surface of the deck.

14. The cab of claim 13, wherein the opening is unobstructed throughout the entire opening radius, wherein the opening radius is approximately 100-170 degrees about a vertical axis through the cab.

15. The cab of claim 13, wherein the opening includes at least one support structure that obstructs the opening, and a total obstruction radius of the at least one support structure is less than or equal to 20 degrees.

16. The cab of claim 15, wherein the at least one support structure is disposed opposite said working side of the cab.

17. The cab of claim 15, wherein the single opening is continuous except for the at least one support structure, such that the single opening presents multiple points of ingress and egress relative to the cab when the first door and the second door are both open.

18. The cab of claim 13, wherein the first door is disposed on a forward-facing access side of the cab.

19. The cab of claim 7, wherein said first opening is substantially orthogonal to said working side, such that the cab is configured for the operator to enter through the first opening as a primary entrance and the second opening as a secondary or emergency entrance.

20. The cab of claim 1, wherein said first opening is disposed on a forward-facing access side of the cab, wherein said second opening is disposed on a side-facing access side that is opposite said working side of the cab.

* * * * *